US007357128B1

(12) United States Patent
Baumgart

(10) Patent No.: US 7,357,128 B1
(45) Date of Patent: Apr. 15, 2008

(54) CLOSED LOOP DEFINED PROFILE CURRENT CONTROLLER FOR ELECTROMAGNETIC RAIL GUN APPLICATIONS

(75) Inventor: Gary E. Baumgart, Pittsburgh, PA (US)

(73) Assignee: Curtiss-Wright Electro-Mechanical Corporation, Cheswick, PA (US)

( * ) Notice: Subject to any disclaimer, the term of this patent is extended or adjusted under 35 U.S.C. 154(b) by 0 days.

(21) Appl. No.: 11/084,226

(22) Filed: Mar. 17, 2005

(51) Int. Cl.
*F41B 6/00* (2006.01)

(52) U.S. Cl. ..... 124/3; 89/8

(58) Field of Classification Search ..... 124/3; 89/8

See application file for complete search history.

(56) References Cited

U.S. PATENT DOCUMENTS 3,343,001 A * 9/1967 Grimsdale et al. ..... 307/87
4,371,801 A * 2/1983 Richter ..... 310/156.36
4,617,507 A * 10/1986 Eisenhaure et al. ..... 322/4
4,754,687 A * 7/1988 Kemeny ..... 89/8
4,836,083 A * 6/1989 Triezenberg ..... 89/8
4,841,181 A * 6/1989 Kemeny et al. ..... 310/12
4,858,513 A * 8/1989 Kememy ..... 89/8
4,928,572 A * 5/1990 Scott et al. ..... 89/8
4,935,708 A * 6/1990 Weldon et al. ..... 322/62
4,987,821 A * 1/1991 Kemeny et al. ..... 89/8
5,081,901 A * 1/1992 Kemeny et al. ..... 89/8
5,125,321 A * 6/1992 Cowan et al. ..... 89/8
5,182,254 A * 1/1993 Owens ..... 505/164
5,540,134 A * 7/1996 Bird, Jr. ..... 89/8
5,721,461 A * 2/1998 Taylor ..... 310/268
5,969,297 A 10/1999 Ambs
6,142,131 A * 11/2000 Wortman et al. ..... 124/3
6,465,908 B1 * 10/2002 Karuppana et al. ..... 307/31
6,923,106 B2 * 8/2005 MacDougall ..... 89/8
2004/0020351 A1 * 2/2004 Yurievich ..... 89/8

* cited by examiner

*Primary Examiner*—Michael J. Carone
*Assistant Examiner*—Stewart T Knox
(74) *Attorney, Agent, or Firm*—Reed Smith LLP

(57) ABSTRACT

A closed loop current controller for an electromagnetic rail gun. It is necessary to control the muzzle velocity of a rail gun accurately for the gun to be a good artillery device. The present invention provides a closed loop control system to accurately regulate the energy transfer to a rail gun projectile and control its muzzle velocity. The rail gun control system includes a state space (state domain) control concept adapted to discrete control events that transition the system from one state to another until the final desired state (i.e., muzzle velocity) is reached. The control regulator preferably generates state transition functions that transition the projectile from state to state according to a defined current profile to provide a specified projectile muzzle velocity. The rail gun closed loop current controller also includes current reference compensation to correct for errors in previous state transitions.

14 Claims, 9 Drawing Sheets

$$T^{PN}_{4-2} = \begin{bmatrix} \sin(0) & \sin(270) & \sin(180) & \sin(90) \\ \cos(0) & \cos(270) & \cos(180) & \cos(90) \end{bmatrix}$$

$$T^{R}_{-90} = \begin{bmatrix} \cos(-90) & \sin(-90) \\ -\sin(-90) & \cos(-90) \end{bmatrix}$$

$$T_{S-R} = \begin{bmatrix} \cos(\alpha_{pa}) & \sin(\alpha_{pa}) \\ -\sin(\alpha_{pa}) & \cos(\alpha_{pa}) \end{bmatrix}$$

CLOSED LOOP DEFINED PROFILE CURRENT CONTROLLER FOR ELECTROMAGNETIC RAIL GUN APPLICATIONS

BACKGROUND OF THE INVENTION

1. Field of the Invention

The present invention relates generally to systems and methods for closed loop control, and, more specifically, the present invention is directed to a closed loop current controller for an electromagnetic rail gun.

2. Description of the Background

Electromagnetic rail gun technology has been in development for over 50 years. To date, some rudimentary prior art systems have been demonstrated, but the technology has not advanced to where practical systems can as of yet be built. Prior systems have not demonstrated the ability to precisely control the muzzle velocity of a projectile, thereby reducing the control of the ejected projectile. Without precise control of the muzzle velocity, the electromagnetic rail gun can not effectively be used as an artillery device.

The basic principle of a rail gun has been well known for quite some time. Generally speaking, the rail gun is comprised of a pair of parallel rails securely fastened to a structure to prevent them from moving while under force. A low impedance conductive projectile is constructed so that it will slide between the rails while making electrical contact with the rails. For projectile motion and ejection, a large pulse of current is delivered to the rails, and the pulse generates orthogonal electric and magnetic fields behind the projectile. These fields produce a force on the projectile that is directed down the center of the rails. Therefore, the force causes the projectile to accelerate in the direction of the applied force (down the length of the rails) until it is ejected from the rail gun.

The most important requirement of the rail gun is the control of the creation and application of the electromagnetic pulse to the rails. Existing control systems used for electromagnetic rail gun applications use only open loop, feed forward controllers with empirically developed algorithms. These prior systems are based on a defined current profile. However, these open loop controllers do not compensate for variations in the system such as changes in alternator resistances, gun resistance, and projectile mass. The muzzle velocity that is critical to the gun accuracy cannot be controlled with precision for these varying conditions.

Closed loop controllers have not been used on electromagnetic gun applications due to several issues. A discharge event occurs during a 5 to 10 millisecond (ms) period. The required closed bandwidth of the controller necessary to control the gun is between 10,000 rad/s and 15,000 rad/s. Thyristor power converters, used to control the current in electromagnetic rail guns are discrete controllers that have an open loop bandwidth typically at or below this frequency. The control of a thyristor bridge is not linear and can occur only at discrete times, and the number of discrete control events during a discharge is limited to between 6 to 8 events. Because of these constraints, open loop, feed forward predetermined algorithmic control techniques have been used for rail gun applications. This type of control is prone to error when the system operating conditions change.

Alternatives to this open loop, feed forward control approach to electromagnetic rail guns are sought in the artillery arts.

SUMMARY OF THE INVENTION

In accordance with at least one preferred embodiment, the present invention provides methods for a closed loop control system to accurately regulate the energy transfer to a rail gun projectile and control its muzzle velocity. Specifically, the present invention utilizes a defined state space (state domain) control concept that is adapted to discrete control events that transition the system from one state to another until the final specified state is reached. The control regulator uses state transition functions that transition the projectile from state to state according to a defined current profile. The regulator controls the gun current that will provide the acceleration of the projectile in the gun so that it reaches a specified velocity (muzzle velocity $v_m$) as it exits the gun.

The invention includes a pulsed alternator observer to measure the alternator voltage and current, a gun observer to calculate the projectile velocity and position in the gun, and a current compensator function to calculate the required current reference for the current controller for the transition functions at each power converter gating event.

The system controller preferably performs several other functions including system sequencing, system protection and pulsed alternator field current control. Gun control logic is provided to coordinate the system sequencing, charging control, discharge control and gun stored energy recovery control process. The system controller also interfaces with a gun loader, and gun control logic is implanted in the system controller for controlling the sequencing of the gun loader mechanism.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

It is to be understood that the figures and descriptions of the present invention have been simplified to illustrate elements that are relevant for a clear understanding of the invention, while eliminating, for purposes of clarity, other elements that may be well known. Those of ordinary skill in the art will recognize that other elements are desirable and/or required in order to implement the present invention. However, because such elements are well known in the art, and because they do not facilitate a better understanding of the present invention, a discussion of such elements is not provided herein. The detailed description will be provided hereinbelow with reference to the attached drawings.

The present invention, in at least one preferred embodiment, provides a closed loop controller for an electromagnetic rail gun. The basic gun operation and its components will be initially discussed below, followed by a detailed discussion of the control approach of the present invention. The present invention preferably comprises a state space (state domain) control approach that is adaptable to discrete control events that transition the system from one state to another—to produce a defined current profile to drive the rail gun.

Gun Model

Figure 1:
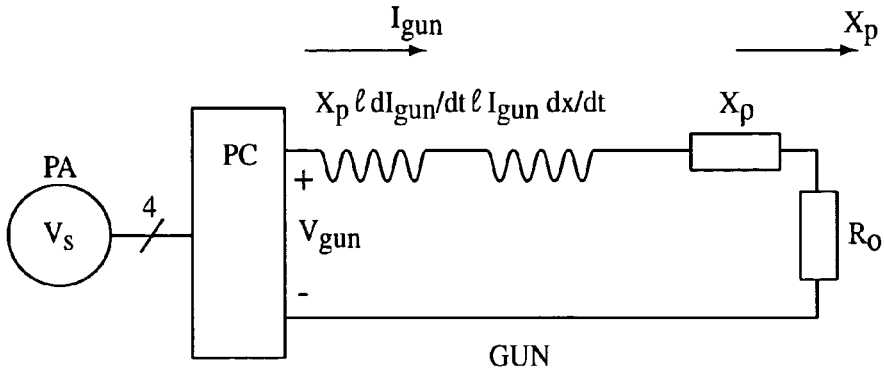
FIG. 1 depicts an electrical model of an electromagnetic rail gun.

The simple mechanical structure of an electromagnetic rail gun can be modeled using an electrical network as generally shown in FIG. 1. The parallel gun rails are modeled as having inductance and resistance, and the projectile is modeled as a resistance. The inductance and resistance of the gun increases as the projectile travels down the rail increasing the active length of the current path and the electromagnetic flux between the rails.

The principle of operation can be understood using the network model in FIG. 1 and classic wave equations for a traveling electromagnetic wave. The equation that defines the network model (FIG. 1) is given here as equation 1:

$$V_{gun} = l \cdot x_p \cdot \frac{dI_{gun}}{dt} + l \cdot I_{gun} \cdot \frac{dx_p}{dt} + (\rho \cdot x_p + R_o) \cdot I_{gun} \quad \text{(equation 1)}$$

where $V_{gun}$ is the gun voltage, $I_{gun}$ is the gun current, $x_p$ is the distance of the projectile from the breech, l is the inductance of the gun per unit length, ρ is the resistance of the gun per unit length, and $R_o$ is the fixed resistance for the gun including the projectile (see FIG. 1).

This equation (equation 1) defines the electrical operation of the rail gun but does not define the mechanical or space-time operation of the projectile. The projectile is propelled from the energy of the expanding electromagnetic fields. These fields are characterized as an expanding wave with continuously increasing propagation velocity ($v_p$) and wavelength (λ). If the expansion is linear then the frequency (ω) is constant and is given by $\omega = v_p/\lambda$.

The equations for the speed and position of the projectile can be developed from classic wave mechanics equations for the rail gun electromagnetic field. The basic equations derived from wave equations for the projectile kinetic energy (U), force on the projectile (F) and the relationship of the magnetic flux field intensity (B) to the gun current are summarized by equations 2, 3, and 4:

$$U = \int_0^{\lambda} dU = \frac{B^2}{\mu} \cdot \chi_E \cdot \chi_B \cdot \frac{v_p}{\omega} \quad \text{(equation 2)}$$

$$F = \frac{1}{v_p} \cdot \frac{dU}{dt} = \frac{B^2}{\mu} \cdot \chi_E \cdot \chi_B \quad \text{(equation 3)}$$

$$B \cong \frac{l \cdot I_{gun}}{\chi_B} \quad \text{(equation 4)}$$

where U is the kinetic energy of the projectile, E is the electric field intensity behind the projectile, B is the magnetic field intensity behind the projectile, ω is the frequency of the electromagnetic wave, F is the force behind the projectile produced by the wave, μ is the permeability ($\mu = 4\pi \times 10^{-7}$ V-s/A-m), $\chi_E$ is proportional to the distance between the gun rails and the shape of the electric field, and XB is proportional to the height of the gun rails and the shape of the magnetic field.

These equations (equations 2, 3 and 4) provide the basis for calculating the mechanical equations for the projectile that include accelerating force and velocity:

$$F = m \cdot a_p = \frac{l^2}{\mu} \cdot \frac{\chi_E}{\chi_B} \cdot I_{gun}^2 \quad \text{(equation5)}$$

$$a_p = \frac{1}{m} \cdot \frac{l^2}{\mu} \cdot \frac{\chi_E}{\chi_B} \cdot I_{gun}^2 \quad \text{(equation 6)}$$

$$v_p = \int_0^t a_p \cdot dt = \frac{1}{m} \cdot \frac{l^2}{\mu} \cdot \frac{\chi_E}{\chi_B} \cdot \int_0^t I_{gun}^2 \cdot dt \quad \text{(equation 7)}$$

where m is the mass of the projectile, $a_p$ is the acceleration of the projectile, and $v_p$ is the velocity of the projectile.

Additional equations can be derived for the stored energy ($U_{stored}$), kinetic energy ($U_{kinetic}$) and loss energy ($U_{loss}$) for the gun using the electrical network equations and the mechanical equations derived from wave equations detailed above.

The magnetic stored energy ($U_{stored}$) in the gun is given by:

$$U_{stored} = l \cdot \chi_p \cdot \int_0^{I_{gun}} I_{gun} \cdot \frac{dI_{gun}}{dt} \cdot dt = l \cdot I_{gun}^2 \cdot \frac{\chi_p}{2} \quad \text{(equation 8)}$$

This is the energy supplied by the pulsed alternator that is not transferred to the projectile. It is stored as magnetic flux in the rail system and can be recovered if the appropriate control techniques are applied.

The projectile kinetic energy ($U_{kinetic}$) can be developed from the wave equations and is given by:

$$U_{kinetic} = \frac{B^2}{\mu} \cdot \chi^E \cdot \chi^B \cdot \frac{v_p}{\omega} = \frac{l^2}{\mu} \cdot \frac{\chi^E}{\chi^B} \cdot I_{gun}^2 \cdot \frac{x_p}{2} = \frac{1}{2} \cdot m \cdot v_p^2 \quad \text{(equation 9)}$$

This is the energy supplied by the pulsed alternator and transferred to the projectile by the electromagnetic wave as kinetic energy.

The gun loss energy ($U_{loss}$) is given by:

$$U_{loss} = \int_0^t (\rho \cdot x_p + R_o) \cdot I_{gun}^2 \cdot dt = \iiint \rho \cdot \frac{l^2}{\mu} \cdot \frac{\chi_E}{\chi_B} \cdot \frac{1}{m} \cdot I_{gun}^4 \cdot dt \cdot dt \cdot dt + \int_0^t R_o \cdot I_{gun}^2 \cdot dt \quad \text{(equation 10)}$$

This is the energy supplied by the pulsed alternator that is not transferred to the projectile motion. It is dissipated as heat in the gun and the projectile and is not recoverable.

The projectile velocity ($v_p$) can be derived from the projectile kinetic energy ($U_{kinetic}$) using equation 9 assuming a constant gun current as shown in equation 11:

$$v_p = l \cdot I_{gun} \cdot \sqrt{\frac{1}{m} \cdot \frac{1}{\mu} \cdot \frac{\chi^B}{\chi^E} \cdot x_p} \quad \text{(equation 11)}$$

where $v_p$ is the projectile velocity and $x_p$ is the projectile position in the gun.

The concepts presented below are generally derived from the physics-based equations developed from the gun network model (FIG. 1) and wave mechanics as summarized above.

Basic Rail Gun System Configuration

For a rail gun to be effective, the projectile must be accelerated to a high velocity with high kinetic energy. The accuracy of the gun as an artillery device depends on the precise control of the projectile muzzle velocity ($v_m$). For a general rail gun application, it will additionally be preferred to control the discharge of multiple projectiles in rapid succession.

The rail gun system generally comprises several components that perform these critical functions. A device or subsystem must be provided to charge an energy storage device with a specified large amount of energy prior to a discharge sequence. A device or subsystem must be provided to store this large amount of energy used for a discharge. A device or subsystem must also be provided to control the delivery of the energy from the storage device to the rail gun. The large discharge current delivered to the rails forms orthogonal magnetic and electric fields that expand behind the projectile and forces the projectile to accelerate over the length of the rails to the gun muzzle.

To provide these functions, a number of critical hardware components are typically required for the system. These components include: a Prime Mover (PM); a Pulsed Alternator (PA); a Field Exciter (FE); a Power Converter (PC); a Gun (GUN); and a System Controller (SC). Each of these components will be discussed in turn below, and FIG. 3 generally depicts a block diagram of these components.

Prime Mover

The prime mover PM can be any of a number of devices ranging from an electric motor to a gas turbine. The prime mover PM is mechanically connected to the pulsed alternator PA and accelerates the pulsed alternator to a specified discharge speed before it is deactivated and allowed to free wheel. During a discharge, stored kinetic energy in the pulsed alternator PA is converted to electromagnetic energy in the gun GUN (to move the projectile down the rails to muzzle velocity $v_m$). After a discharge sequence, the prime mover PM must be reactivated to recharge the system by driving the pulsed alternator PA speed back to the discharge speed.

Pulsed Alternator

The prime mover PM serves as the energy-charging device, and the rotating inertia of the pulsed alternator PA serves as the energy storage device. This energy is stored as kinetic rotational energy given by equation 12:

$$U_{stored} = \frac{J_{PA}}{2} \cdot \omega_{PA}^2 \quad \text{(equation 12)}$$

where $J_{PA}$ is the pulsed alternator inertia and $\omega_{PA}$ is the generator angular velocity. During a discharge, the power converter PC converts stored kinetic energy ($U_{stored}$) in the pulsed alternator PA to electromagnetic energy in the gun GUN.

High-energy rail gun systems may require more than one pulsed alternator PA and prime mover PM to charge and store the discharge energy for the gun GUN. When the pulsed alternators PA are disengaged from the prime mover PM prior to a discharge sequence, they are not necessarily operating at the same speed or in phase. When current begins to flow from the pulsed alternators PA to the gun GUN, the phase differences between pulsed alternators generate torque that will tend to synchronize the machines. However, large phase differences will produce large torques if the currents are unrestricted. It is preferable to pre-synchronize the pulsed alternators PA at low current levels just prior to the discharge. This will reduce the stress produced by the synchronizing torque on the machines at the time the discharge current is allowed to flow. A device used to control the synchronization current is preferably provided in the control system. A detailed discussion of such a synchronization system is found in U.S. patent application Ser. No. 11/084,227 filed on filed on Mar. 17, 2005 entitled "Synchronization Controller For Multiple Pulsed Alternator Applications" with the same inventor and assignee as the present invention, and which is incorporated by reference into the present disclosure in its entirety.

Field Exciter

The field exciter FE and power converter PC are used to control the delivery of the stored energy from the pulsed alternator PA to the gun GUN. The field exciter FE controls the magnetic flux level in the pulsed alternator PA to facilitate the delivery of a current pulse to the gun GUN. During a discharge cycle, the field current typically is unregulated and will be allowed to free wheel through a diode at its pre-discharge level.

Power Converter

The power converter PC changes the ac current developed by the pulsed alternator PA to an electromagnetic wavefront in the gun GUN. The power converter PC is capable of controlling the level of current and typically comprises a phase controlled thyristor half-wave bridge. For the purpose of discussion herein, it will be assumed that a four-phase power system will be used. However, the number of pulse alternators, pole number or phase number does not limit the basis of the present invention.

The thyristor power converter is a non-liner discrete controller that has a limited control bandwidth. The power converter instantaneous output voltage can be expressed in terms of existence equations that define the power converter state for each phase. The instantaneous output (not including commutation transients) of the thyristor power converter modeled by the summation of the switch existence equations for each phase as shown in FIG. 2.

Figure 2:
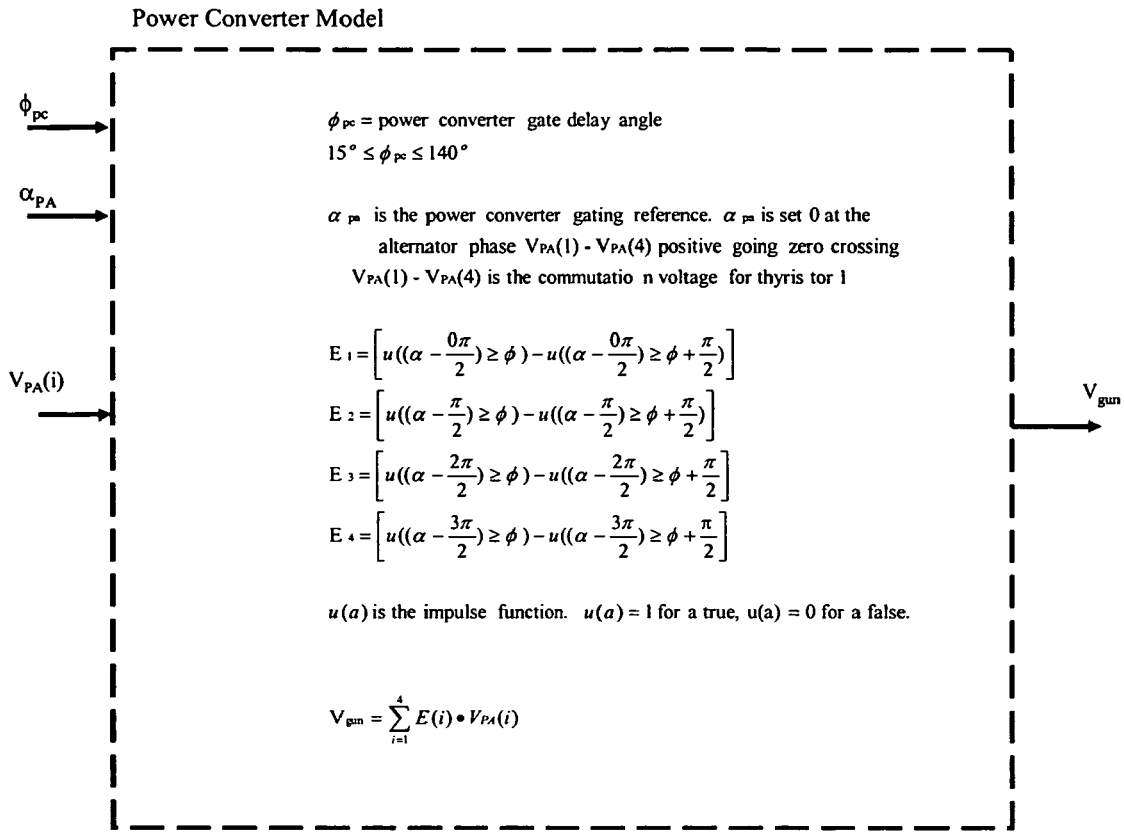
FIG. 2 shows a power converter model using switch existence equations.

As shown in FIG. 2, the power converter is a nonlinear function controlled by the gate delay angle $_{pc}$. The gate delay angle $\phi_{pc}$ is the voltage angle that each thyristor is commutated with respect to the input phase voltages given by $\alpha_{pa}$. The power converter gate reference angle $\alpha_{pa}$ is preferably derived from a pulsed alternator position sensor on the pulsed alternator that is aligned with the pulsed alternator d-q axis and the $V_1$-$V_4$ phase to phase voltage.

The average output voltage $V_0$(avg) is given by equation 13:

$$Vo(\text{avg}) = n \cdot \frac{\sqrt{2}}{\pi} \cdot q \cdot \sin\left(\frac{\pi}{p}\right) \cdot \sin\left(\frac{\pi}{q}\right) \cdot \cos(\phi_{pc}) \cdot V_{PA} \quad \text{(equation 13)}$$

Where q is the number of pulses per cycle, p represents the number of phases, and n is the number of half bridges.

In addition to regulating the energy delivered to the projectile during a discharge cycle, the power converter PC must be able to regenerate the energy stored in the inductance of the gun GUN after the projectile exits. A device or subsystem is therefore provided to conduct the gun current without arcing after the projectile exits the muzzle and to limit the muzzle voltage to a specified maximum level. If this is not provided, the gun voltage will exceed the range of control of the power converter PC. A muzzle shunt is preferably provided for this purpose.

The muzzle shunt is sized to limit the gun voltage to a level that can be commutated by the power converter PC. This is based on the maximum average voltage output of the power converter and the final gun current. This value is given by:

$$R_{shunt} \leq \frac{\sqrt{2}}{\pi} \cdot q \cdot \sin\left(\frac{\pi}{p}\right) \cdot \sin\left(\frac{\pi}{q}\right) \cdot \cos(\phi_{\max}) \cdot \frac{V_{gun}}{I_{gun}} \quad \text{(equation 14)}$$

Where $R_{shunt}$ is the value of the shunt, $V_{PA}$ is the pulsed alternator terminal voltage, $I_{gun}$ is the gun current, p is the number of pulsed alternator phases, q is the number of the power converter pulses per cycle, and $\phi_{max}$ is the power converter maximum gate delay angle.

Each of these elements is preferably controlled by an integrated control system. One preferred control system according to the present invention regulates the delivery of the energy to the projectile so that the muzzle velocity of the projectile is predictable and controllable. To accomplish this, a high performance system controller closed loop feedback controller is employed.

System Controller

The most critical functions of the control system (or system controller SC) in discharging a projectile are the power converter and the gun controller functions. A high bandwidth controller is required to sample the system feedback signals, process the control algorithms and produce gate signals for the power converter necessary for these two functions.

The power converter is preferably a half-wave phase controlled thyristor bridge rated for the pulse current delivered to the gun. Because the discharge process is completed in less than 10 ms, the timing demand on the control system is critical. Prior art controller technology uses open loop controls where the gate delay angle of the power converter is rapidly advanced to zero degrees (0°) to full conduction. At full conduction, the power converter operates as a half-wave receiver. The kinetic energy stored in the pulsed alternator is effectively dumped into the gun in an uncontrolled process. The amount of energy actually transferred to the projectile depends on many factors, including: (1) pulsed alternator losses; (2) gun losses; (3) pulsed alternator inductance; (4) rectifier losses; (5) gun inductance; (6) projectile resistance; and (7) projectile mass.

With this number of variables, it is difficult if not impossible to predict the actual amount of energy that will be transferred to the projectile with an open loop control strategy (as used in the prior art). To control the muzzle velocity of the projectile with precision demands a closed loop control system that can actually control the amount of energy delivered to the projectile.

According to the present invention, a closed loop control system is presented that will control the prime movers, pulsed alternators, field exciters, power converters and a gun equipped with an automatic loader to facilitate multiple discharges of the gun in rapid succession. The control system will regulate the energy delivered to the projectile and energy recovery from the stored energy of the gun.

Controller Configuration and System Interface

Figure 3:
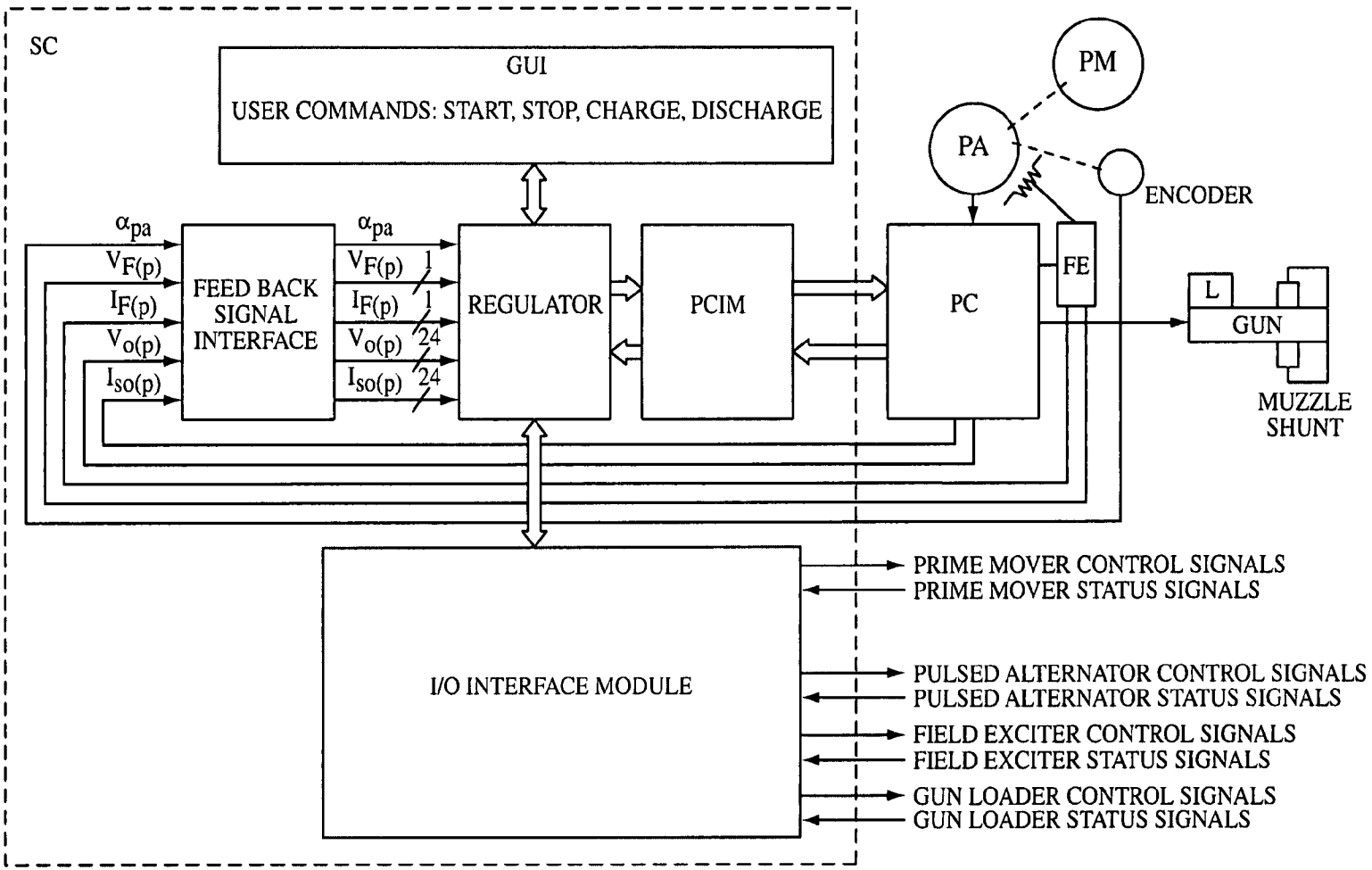
FIG. 3 shows an exemplary rail gun system controller block diagram.

A block diagram of a rail gun system controller and control interface is shown in FIG. 3. The system will preferably include a graphical user interface GUI to communicate to the system controller SC. Setup and command signals are sent to the controller from this user interface GUI, and system status signals are returned to the user via the interface.

A current controller for the gun will preferably perform important control functions for the system. For example, the controller will send gate pulse control signals to the power converter PC. The power converter PC will produce a voltage that will generate a current in the gun GUN. The system controller will use current and voltage feedback signals and rotor position from the pulsed alternator to control the power converter PC and the gun GUN. The system controller will preferably provide peripheral controls for the prime mover PM, field exciter FE, and gun loader GL to automatically load a projectile into the breach of the gun on command.

Control Strategies

The primary function of the gun controller is to regulate the energy delivered to the gun and to accelerate the projectile to a specified muzzle velocity when it exits the gun. There are several strategies that can be incorporated into a closed loop controller to regulate the energy delivered to the gun and to accelerate the projectile. For example, a first strategy incorporates a defined current profile regulator. This approach allows the muzzle velocity to be controlled indirectly by controlling the gun current and the energy delivered to the projectile during the discharge. A more direct approach is based on a defined velocity profile controller that controls the projectile velocity directly during the discharge cycle. This disclosure describes the first approach based on a defined current profile controller.

Defined Current Profile Regulator

Figure 4:
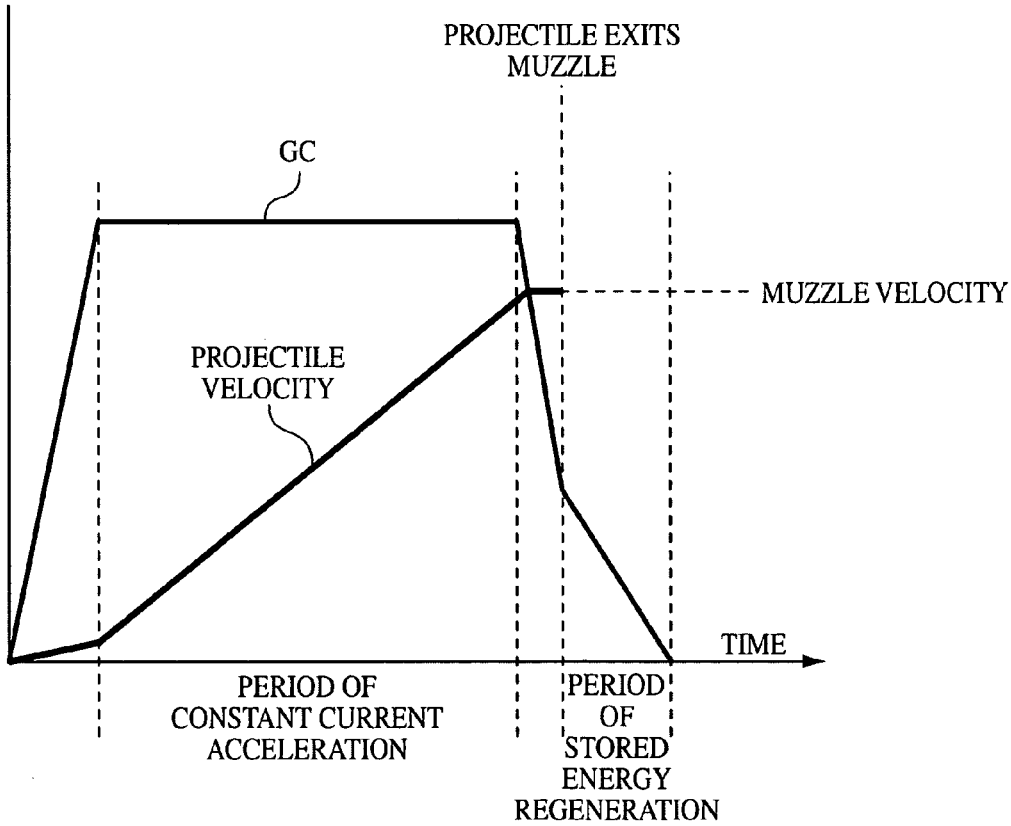
FIG. 4 shows an exemplary defined current profile for an electromagnetic rail gun.

The defined current profile regulator produces a time variant current profile that has been predetermined to provide a specified discharge and acceleration of the projectile in the rail gun. It is desirable to provide a nearly constant acceleration of the projectile. An exemplary trapezoidal current profile as shown in FIG. 4 will provide the required acceleration. The current profile is defined to provide a specified projectile muzzle velocity.

As shown in FIG. 4, the trapezoidal gun current profile is implemented by ramping the gun current GC to a specified level and holding the gun current constant for a specified duration. After this period of constant gun current (accelerating the projectile down the rails), the gun current GC is then rapidly decreased near the end of a discharge cycle. During the application of the constant gun current GC, the projectile velocity $v_p$ increases linearly. Upon rapid decreasing of the gun current GC, the projectile exits the muzzle of the rail gun at its muzzle velocity $v_m$.

The gun current GC is rapidly ramped from zero (0) to a specified discharge current level using a ramp function generator. At the end of the ramp period the projectile will have achieved a velocity $v_p$ and will be a distance $x_p$ from the breach. The end effects of the discharge current profile must be taken into account in determining the peak current level necessary to achieve the required projectile muzzle velocity $v_m$. The projectile energy state can be defined by its velocity and position in the gun as given by the following two equations:

$$v_m = \int_o^{tm} a_p \cdot dt = \frac{1}{m} \cdot \frac{l^2}{\mu} \cdot \frac{\chi^E}{\chi^B} \cdot \int_o^{tm} I_{gun}^2 \cdot dt \quad \text{(equation 15)}$$

$$x_{gun} = \int \int_0^{tm} a_p \cdot dt \cdot dt \quad \text{(equation 16)}$$

Where $a_p$ is defined by equation 6.

The solution of this system of equations (equations 15 and 16) will yield the gun current $I_{gun}$ such that at time "$t_m$" the projectile velocity will be at a specified value $v_m$ when the projectile is at the gun muzzle $x_m$. A classic closed loop controller could be used to control the gun current to a specified profile if the system were linear, time continuous and the system open loop bandwidth were sufficiently high. However, this is not the case in practice. The closed loop control constraints require that a different type of closed loop control be used. The closed loop control concept for the present invention uses a system state observer to monitor the system and an adaptable control to define discrete control events that transition the system from one specified state to another. State transition functions are used to adjust the current reference to the controller to force the final state to a specified muzzle velocity $v_m$.

Theory of Operation

Closed loop controllers have not previously been used on electromagnetic gun applications because of the constraints discussed above. The direct application of closed loop linear control theory to control a rail gun discharge cycle is problematic due to several factors. First, a pulsed discharge to launch a projectile occurs during a 5 to 10 ms period and only 6 to 8 control events can occur during that period. Second, the required closed loop bandwidth of the regulator necessary to control the gun is between 8,000 rad/s and 15,000 rad/s. Thyristor power converters, used to control the current in electromagnetic rail guns are discrete controllers that have an open loop bandwidth typically at or just below this frequency. The control of a thyristor bridge is not linear and can occur only at discrete times. The closed loop control according to the present invention will overcome these difficulties.

A state transition equation (equation 17) can be developed from equation 11 presented previously to calculate muzzle velocity:

$$\sqrt{v_m^2 - v_p^2} = l \cdot I_{gun} \cdot \sqrt{\frac{1}{m} \cdot \frac{1}{\mu} \cdot \frac{\chi^B}{\chi^E} \cdot (x_m - x_p)} \quad \text{(equation 17)}$$

This equation defines the transition of the projectile with constant gun current from a position $x_p$ and a projectile velocity $v_p$ to the final state at the muzzle with a position $x_m$ and a projectile velocity $v_p$. Equation 17 will be used to define the current that would produce the desired projectile muzzle velocity $v_m$ at the muzzle position $x_m$.

The control system is preferably defined discretely, and there are only a few control events during a discharge cycle. The state transition equation (equation 17) is applied repeatedly at the control events to recalculate the gun current. At the beginning of a discharge cycle, the predicted current required for a specified muzzle velocity will be relatively high due to loop gain errors, time delays in the system and variations in the gun parameters. The error for each transition will be calculated and used to correct future transitions. As the projectile nears the gun muzzle, the error for muzzle velocity will decrease due to previous corrections to the gun current controller gain and previous state transitions.

In at least one preferred embodiment, the present invention provides a state space (state domain) control concept that is adaptable to discrete control events that transition the system from one state to another until the final specified state is reached at the muzzle.

Figure 5:
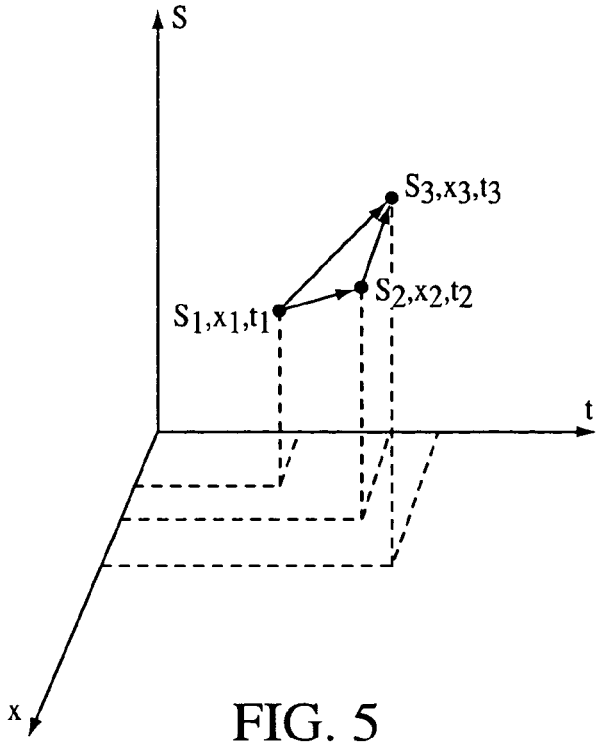
FIG. 5 shows an exemplary system state diagram.

A defined system can be represented in three dimensions: system state (S), space (x) and time (t). A convenient way to express the state of a defined system is to evaluate the total energy of the system. In this way, the projectile traveling in a rail gun can be represented by its position in the barrel at a specified time, and the kinetic energy of the projective given by $\frac{1}{2}*m*v_p^2$. In FIG. 5, a system is located in a state diagram at ($S_1$, $x_1$, $t_1$). Assume that it is necessary that the system transition from an initial condition ($S_1$, $x_1$, $t_1$) to a final condition ($S_3$, $x_3$, $t_3$) where $S_3=\frac{1}{2}*m*v_m^2$, $x_3=x_m$ and $t_3=t_m$. There are an infinite number of trajectories for the system to make the transition. Each trajectory requires an exchange of energy with the environment except for the case where $S_1=S_3$. However, there is only one trajectory that is direct in space and time, and that trajectory is shown in FIG. 5.

This transition can be expressed by the equation $S_3=S_1+f(x,t)$ where f(x,t) is a function of space and time that defines the exchange of energy of the defined system with the environment. This will be referred to herein as a "state transition function."

There are other options for the transition. For example, the system can, in general, transition to an intermediate point ($S_2$, $x_2$, $t_2$) before transitioning to ($S_3$, $x_3$, $t_3$). The state transition equations for this trajectory are given by equations 18-20:

$$S_2=S_1+g(x,t) \quad \text{(equation 18)}$$

$$S_3=S_2+h(x,t) \quad \text{(equation 19)}$$

$$S_3=g(x,t)+h(x,t) \quad \text{(equation 20)}$$

Where g(x,t) is a function of space and time that defines the exchange of energy from $x_1$ to $x_2$, and h(x,t) is a function of space and time that defines the exchange of energy from $x_2$ to $x_3$.

For a projectile subjected to constant current acceleration, the change in kinetic energy (ΔU) between any two points in state space is given by the following state transition function (equation 21):

$$\Delta U_{2-1} = S_2 - S_1 = \frac{l^2}{\mu} \cdot \frac{\chi_E}{\chi_B} \cdot I_{gun}^2 \cdot \frac{x_2 - x_1}{2} = \frac{1}{2} \cdot m \cdot (v_2^2 - v_1^2) \quad \text{(equation 21)}$$

This equation (equation 21) can be used to derive the functions g(x,t) and h(x,t) to make the state transitions from $S_1$ to $S_2$ and from $S_2$ to $S_3$. In a like manner, the transition between $S_1$ and $S_3$ can be divided into any number of segments, and transition functions can be calculated that will produce almost any trajectory necessary. Therefore, transition functions can be used to produce virtually any desirable velocity profile. The transition will coincide with the control events of the power converter to compensate for the discrete control characteristics of the thyristor converter.

Closed Loop Current Regulator

To implement this control strategy, it is necessary to measure pulsed alternator stator voltage, stator current, and stator shaft position. These are used by the pulsed alternator observer to calculate the gun current and the gun breach voltage. The gun current and breach voltage are used in a gun observer to calculate the projectile velocity and position in the gun barrel. In addition, it is necessary to provide a current reference ramp generator RAMP, a gun current controller, and a state transition-current controller compensation function COMP that discretely adjusts the current reference at each control event to produce the required transition functions from one control event to the next and to account for time delays and nonlinearity in the control system and the gun.

Figures 6A, 6B:
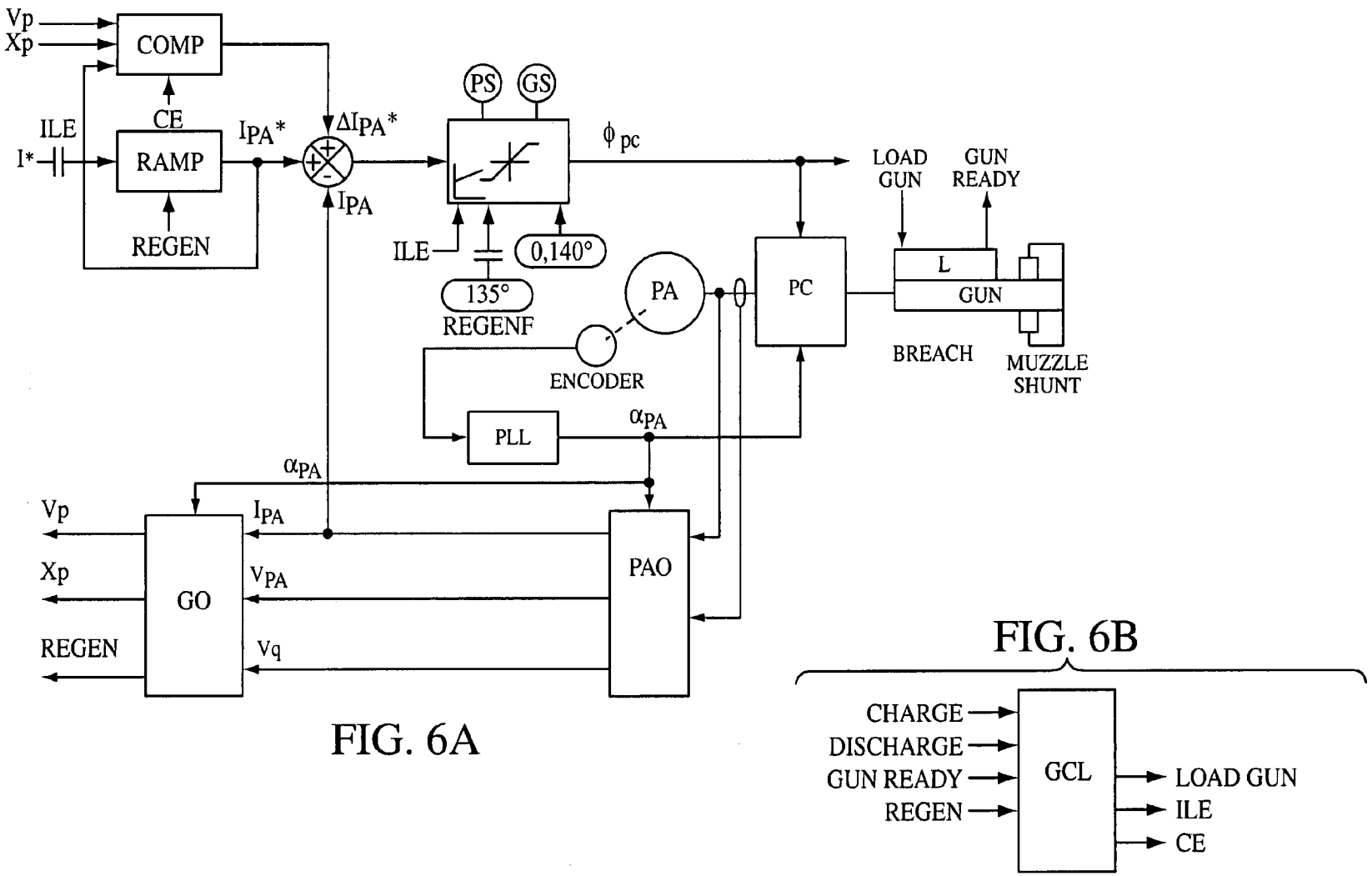
FIG. 6 shows an exemplary rail gun defined current regulator in block diagram format (FIG. 6A) with accompanying gun control logic (FIG. 6B)

FIG. 6A is a block diagram for an exemplary defined current profile closed loop controller for an electromagnetic rail gun. FIG. 6A is a block diagram for an exemplary defined current profile closed loop controller for an electromagnetic rail gun. The controller of FIG. 6 utilizes a pulsed alternator observer PAO to measure the alternator voltage and current, a gun observer GO to calculate the projectile velocity and position, a current reference ramp generator RAMP, a state transition-current controller compensator function COMP to calculate the required current reference for the current controller for the transition functions at each gating event, a gun current controller to control the current to the gun, a phase lock loop PLL to maintain synchronism of the power converter gating reference with the pulsed alternator internal voltage and gun control logic GCL (see FIG. 6B).

Typically, there are between 6 and 8 gating events during a discharge and, therefore, 6 to 8 discrete control events at approximately 1000 μs intervals. However, the control loops will preferably be executed at high rates with sample frequencies of 50 kHz and a processor cycle time of 20 μs. This will allow the controller to track the projectile with high resolution to the next gating event.

Pulsed Alternator Observer

The pulsed alternator PA voltage and current can be used as an observer PAO during the discharge. The alternator voltage and current will then be used in the gun observer GO to calculate the gun current and breach voltage.

Figures 7A, 7B, 7C, 7D:
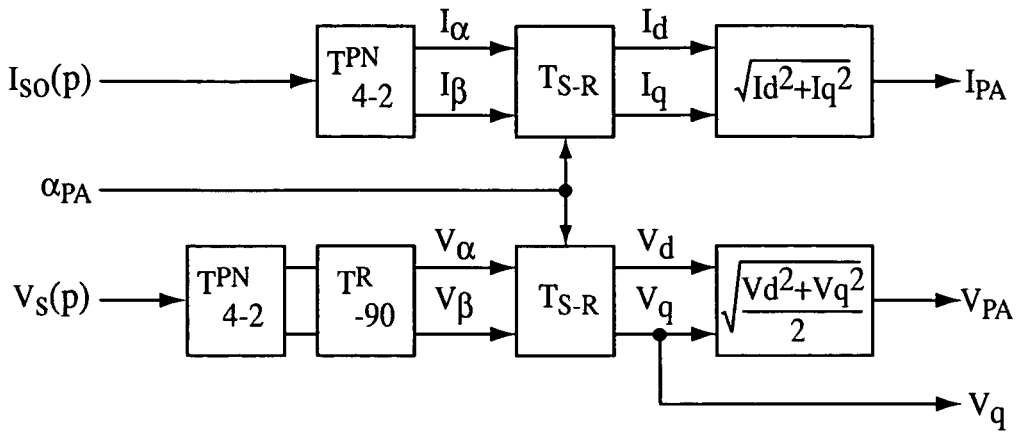
FIG. 7 shows pulsed alternator observer transformations (FIGS. 7A-7D)

The pulsed alternator used in this example produces four-phase current waves that are transformed to equivalent two-phase waves using the $T^{PN}_{4-2}$ transform. The two-phase waves are then transformed, using the TSR transformation, to a rotating reference variable synchronous with the pulsed alternator rotor as shown in FIG. 7A. These transformed values represent the state domain values for the pulsed alternator current and is a constant for constant amplitude phase current.

In a like manner, the pulsed alternator four-phase line-to-line voltage is transformed to the equivalent two-phase wave using the $T^{PN}_{4-2}$ transform (FIG. 7B). The wave is then rotated −90 degrees using the $T^{R}_{-90}$ (FIG. 7C). The two-phase waves are then transformed, using the TSR transformation, to a rotating reverence variable synchronous with the alternator rotor (FIG. 7D). This represents the state domain value for the alternator phase voltage.

Gun Observer

Figure 8:
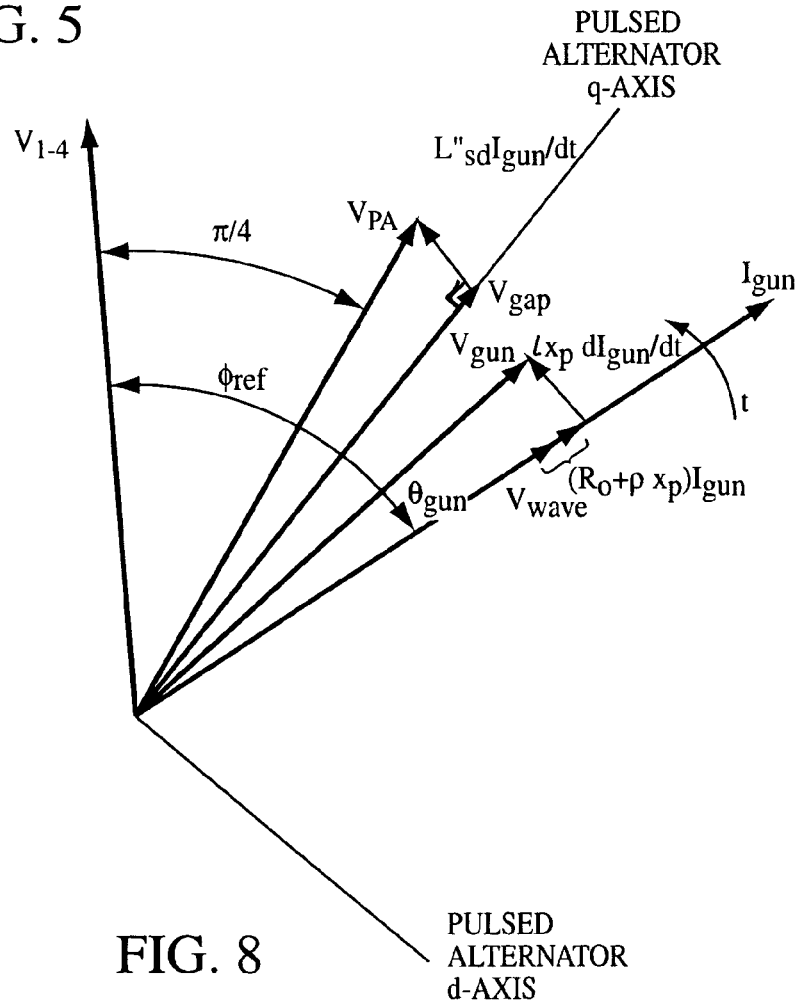
FIG. 8 depicts a gun observer phasor referenced to the state domain.

The relationship of the pulsed alternator current and voltage to the gun current and voltage is also shown in FIG. 8. The pulsed alternator observer reference system is aligned with the pulsed alternator d-q axis and the $V_1$-$V_4$ phase to phase voltage. The position sensor on the pulsed alternator provides the observer reference system. The gun reference system is aligned with the gun current $I_{gun}$. The gun reference system, at the initiation of a discharge, is aligned to the pulsed alternator d axis and moves towards the pulsed alternator phase-to-phase terminal voltage angle during the discharge.

Figure 9A:
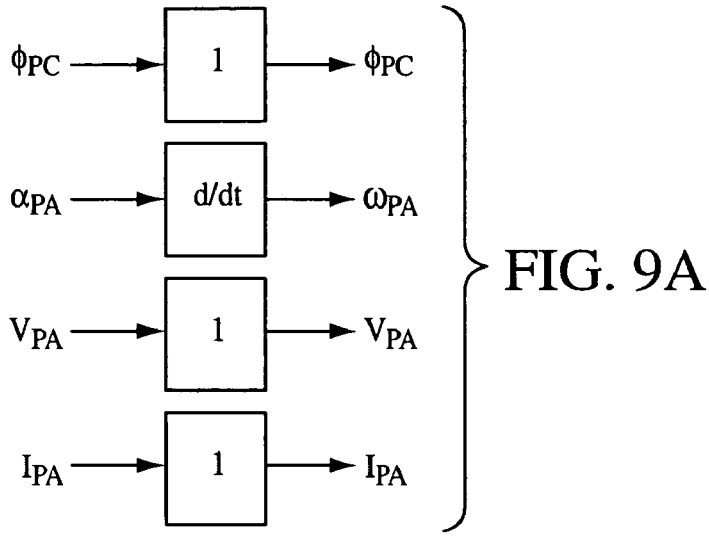
FIG. 9 shows calculations for an electromagnetic rail gun including gun voltage (FIG. 9B), gun current (FIG. 9C), and the angle between the current and the voltage referenced to the pulse alternator rotor position (FIG. 9D), each of these calculations based on the exemplary magnitudes of the pulsed alternator currents, voltage, and rotating frequency (FIG. 9A)
Figure 9B:
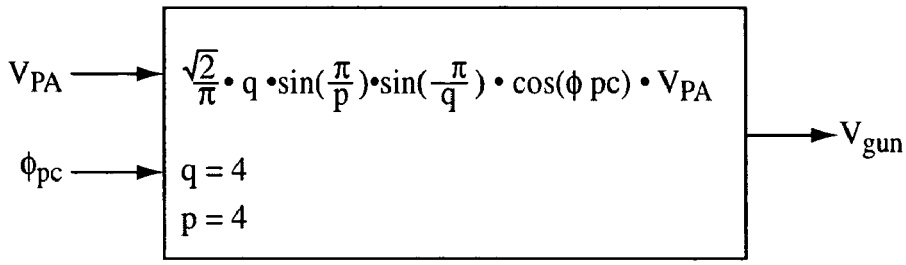
Figure 9C:
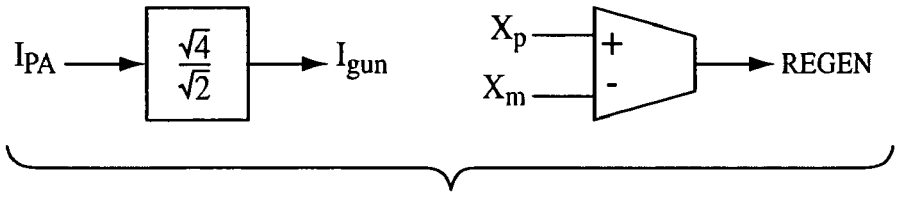
Figure 9D:
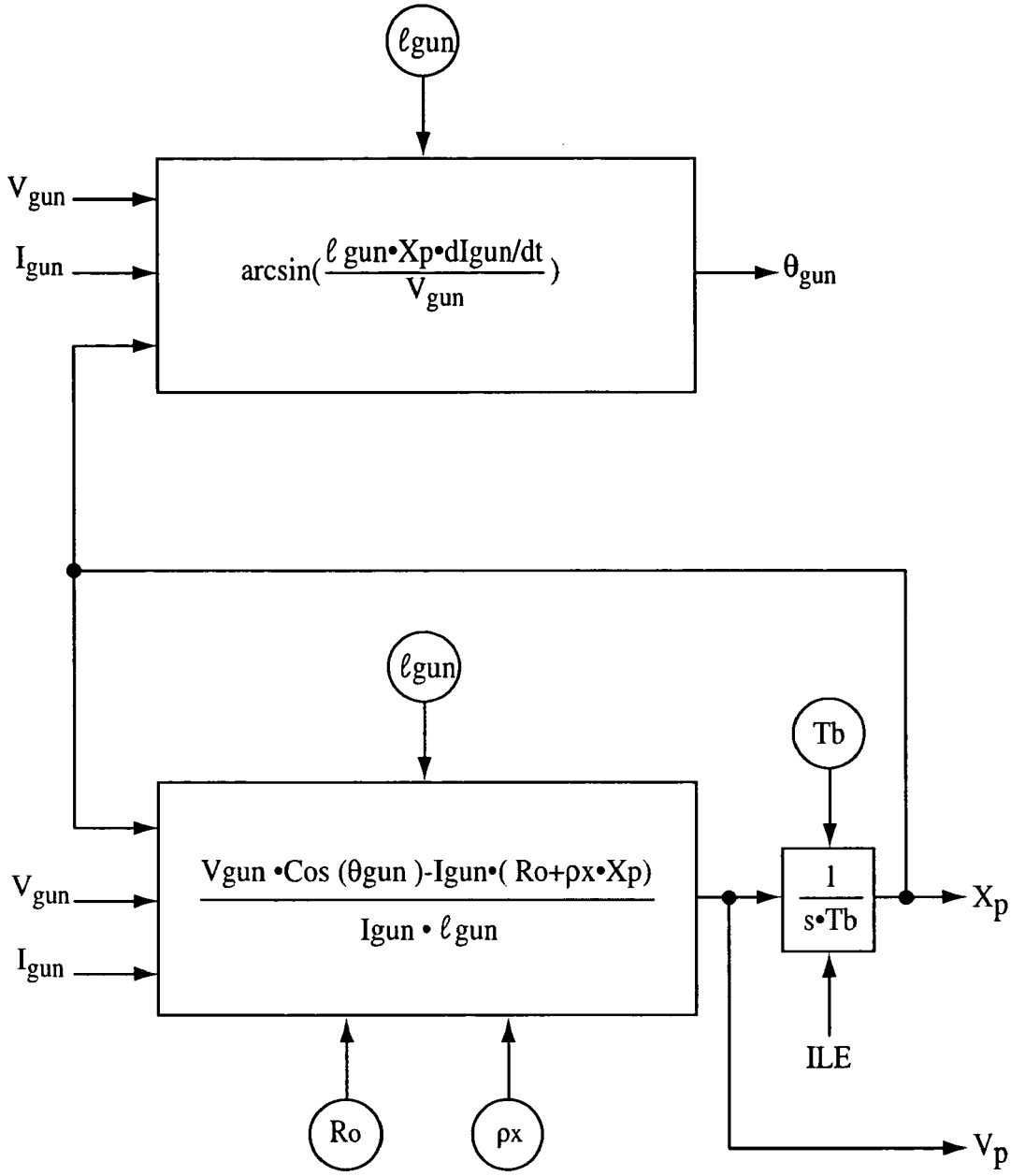

In FIG. 9, the magnitudes of the pulsed alternator currents voltage and rotating frequency (FIG. 9A) are used to calculate the gun breech voltage $V_{gun}$ (FIG. 9B), gun current $I_{gun}$ (FIG. 9C) and the angle between the current and the voltage referenced to the pulse alternator rotor position ($\theta_{gun}$) (FIG. 9D).

The gun breach voltage is calculated from the alternator phase voltage using the power converter algorithm presented in FIG. 2. The gun current is calculated from the pulsed alternator current using the multiplier $\sqrt{4}/\sqrt{2}$ for a four-phased machine. The projectile velocity is calculated using equation 1 for the gun model shown in FIG. 1 and the phasor relationship shown in FIG. 8. The projectile velocity is directly proportional to $\sin(\theta_{gun})$, and the projectile position is the calculated by integrating the projectile velocity.

State Transition-Current Controller Compensator

The state transition-current controller compensator (from FIG. 6) calculates the required current reference adjustment, $\Delta I_{pc}(2)^*$, for the current controller to produce the required state transition at each control event. The current reference adjustment algorithm is shown here:

$$\Delta I_{PA}(2)^* = \left[\frac{\sqrt{v_m^2 - v_p(1)^2}}{l\sqrt{\frac{1}{m}\cdot\frac{1}{\mu}\cdot\frac{\chi^E}{\chi^B}\cdot(x_m - x_p(1))}}\right]\cdot\frac{1}{K(1)} - I'_{PA} \quad \text{(equation 22)}$$

$$K(1) = (G\cdot\Delta Ts + P)\cdot Kp\cdot\Delta K(1) \quad \text{(equation 23)}$$

$$Kp \cong Kpc\cdot\frac{1}{\omega_{pc}\cdot L''_{PA}} \quad \text{(equation 24)}$$

$$\Delta K(1) = \frac{\Delta I_{PA}(1)^*}{I_{PA}(0) - I_{PA}(1)} \quad \text{(equation 25)}$$

where $\Delta I_{PA}(2)^*$ is the current reference adjustment for the next control event, $I_{PA}^*$ is the current reference used to drive the previous state transition, G is the integral gain of the PI controller, P is the proportional gain of the PI controller, $\Delta T_S$ is the sample period for the integrator, $K_{pc}$ is the nominal gain for the power converter, $\omega_{pc}$ is the nominal operating frequency of the power converter, $L''_{PA}$ is the sub-transient reactance of the pulsed alternator, and $I_{PA}(0)$ is the current from the previous control event. Further, $I_{PA}(1)$ is the current resulting from the existing control event, and $\Delta I_{PA}(1)^*$ is the current reference adjustment for the existing control event.

The first component (in brackets in equation 22) calculates the required current reference to transition the system from the existing state to the final state where the projectile velocity $v_p = v_m$ at the gun muzzle where $x_p = x_m$ using equation 17 defined above. The compensated current reference will be activated at the time of the next gating event for the power converter. However, the control event is dependent on the value of the current compensation that makes the time of the event a variable. The value of the gate delay angle $\phi_{pc}$ is continuously calculated as a function of $\Delta I_{pc}(2)^*$. When $\phi_{pc}$ is equal to or exceeds the power converter reference angle $\alpha_{pa}$, then the power converter thyristor is gated. This will cause the power converter to produce the gun current for the control event.

The second component, K(1) in equation 22, calculates the adjusted open loop gain of the gun current control loop. K(1) is equal to the product of the current controller gain given by ($G*\Delta T_s+P$), the system plant gain given by Kp and a gain correction factor given by $\Delta K(1)$. The plant gain is not linear, but, as shown above, it is proportional to the power converter gain Kpc and inversely proportional to the product of the power converter frequency $\omega_{pc}$ and the alternator sub-transient inductance $L''_{pa}$. The power converter gain and the power converter frequency are dependent on alternator operating conditions. Therefore, it is necessary to provide a correction for Kp. $\Delta K(1)$ provides this correction using a first order extrapolation (see equation 25).

Figure 10:
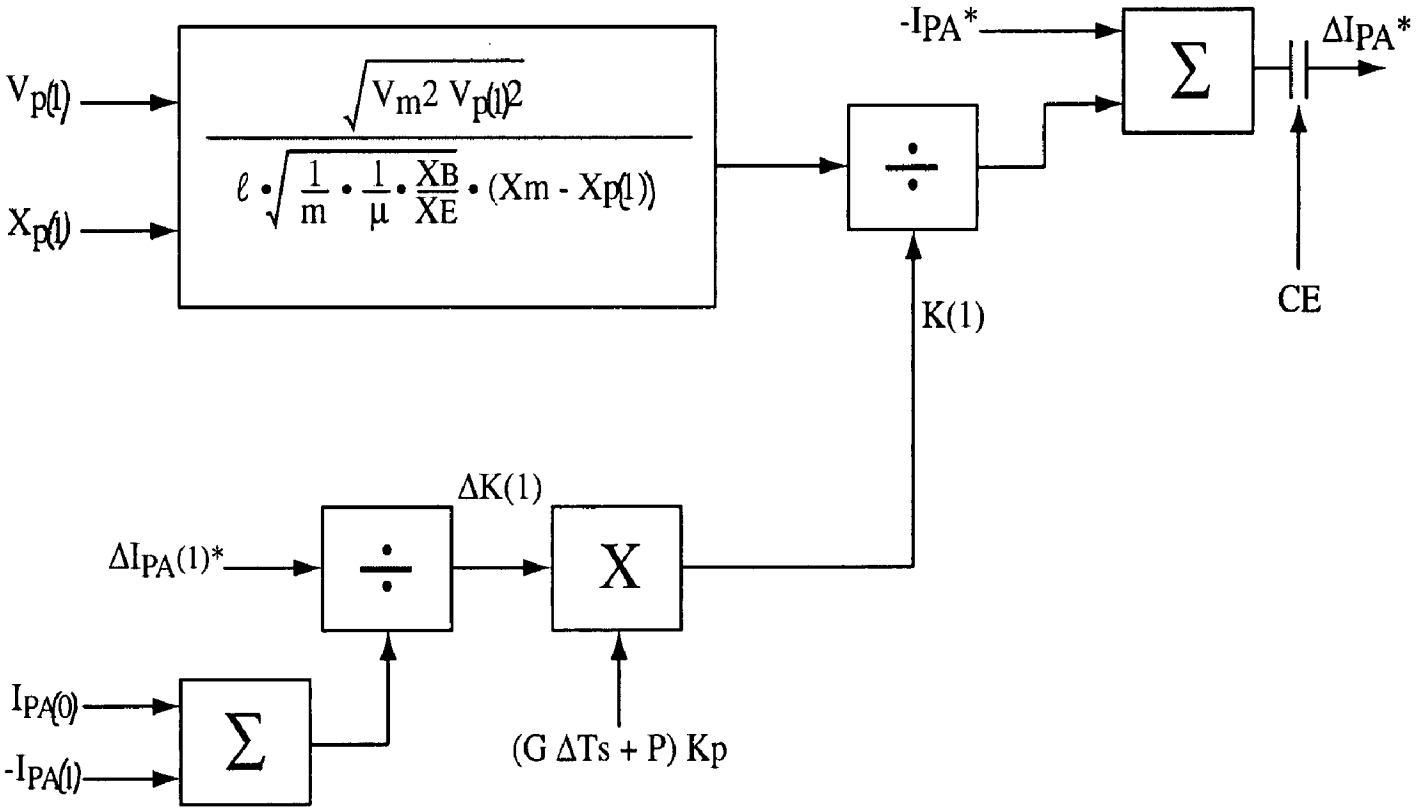
FIG. 10 shows a block diagram of an exemplary state transition and current control compensator.

The total current compensator function including open loop gain correction is shown in FIG. 10. The current compensation signal is injected into the summing junction of the proportional plus integral PI controller shown previously in FIG. 6. The current compensation is only activated during the period after the gun current has been ramped to the discharge level given by $I_{PA}*$ and the time the projectile exits the muzzle. This is controlled by the sequencing control signal CE.

Nothing in the above-description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. An electromagnetic rail gun comprising:
- two gun rails;
- a projectile slidingly engaged between said rails;
- at least one pulsed alternator for generating a pulsed current;
- at least one power converter for applying said generated current to said rails; and
- a closed-loop controller for controlling a muzzle velocity of said projectile, comprising:
  - a means for measuring alternator current and alternator voltage;
  - a means for calculating an anticipated velocity of said projectile using information about said alternator current and said alternator voltage to calculate electrical and magnetic fields impacting said projectile;
  - a means for calculating a rail current that will result in a specified projectile muzzle velocity using information regarding said electrical and magnetic fields; and
  - a means for adjusting said gun current, wherein said closed-loop controller does not include a sensor on said rail gun providing information about a speed of said projectile.

2. The rail gun of claim 1, wherein said closed-loop controller calculates said anticipated velocity of said projectile at discrete times and calculates adjustments to the rail current necessary to result in a specified exit velocity.

3. The rail gun of claim 1, wherein said closed-loop controller calculates said anticipated velocity of said projectile multiple discrete times during discharge of said projectile.

4. The rail gun of claim 1, further comprising:
- a second pulsed alternator operatively connected to said at least one power converter for generating a pulsed current.

5. The rail gun of claim 4, wherein current outputs from said first and second pulsed alternators are synchronized.

6. The rail gun of claim 1, further comprising:
- a second power converter operatively connected to the rails for applying said generated current to said rails.

7. The rail gun of claim 1, further comprising:
- a gun observer for monitoring the current within the rails.

8. A method for controlling the muzzle velocity of a projectile in an electromagnetic rail gun comprising the steps of:
- measuring alternator current and alternator voltage;
- calculating electrical and magnetic field states impacting said projectile;
- calculating an anticipated velocity based on said calculated electrical and magnetic field states;
- generating a pulsed current with at least one pulsed alternator, wherein said pulsed current is based on said anticipated velocity;
- applying said generated pulsed current to the rails using at least one power converter to move said projectile down the rails according to said calculated electrical and magnetic field states.

9. The method of claim 8, further comprising the step of:
- calculating a compensation current reference for each electrical and magnetic field state calculation responsive to errors detected in previous electrical and magnetic field states.

10. The method of claim 8, wherein said measuring step is accomplished using a pulsed alternator observer.

11. The method of claim 8, further comprising the step of:
- monitoring the rail a rail current using a gun observer.

12. The method of claim 8, further comprising the step of
- automatically loading a second projectile into said rail gun after discharging said first projectile.

13. The method of claim 12, further comprising the step of:
- applying a second sequence of pulsed currents to the rails using at least one power converter to move said second projectile down the rails according to said calculated state transitions.

14. An electromagnetic rail gun incorporating state transitions, comprising:
- two gun rails;
- a projectile slidingly engaged between said rails;
- at least one pulsed alternator for generating a pulsed current;
- at least one power converter for applying said generated current to said rails;
- a pulsed alternator observer for monitoring the voltage and current of said at least one pulsed alternator;
- a gun observer for monitoring the current within the rails;
- a gun loader for automatically loading additional projectiles into sliding engagement between said rails;
- a means for calculating electrical field and magnetic field states based on said voltage and current of said at least one pulsed alternator; and
- a means of calculating a rail current that will result in a specified projectile muzzle velocity, wherein said rail gun does not include a sensor on said rail gun providing information about a speed of said projectile.

* * * * *